United States Patent [19]

Mayer

[11] 4,056,936

[45] Nov. 8, 1977

[54] BENTHIC SEMI-BARRIER TO CONTROL THE GROWTH OF WEEDS IN AQUATIC ENVIRONMENTS

[76] Inventor: J. Richard Mayer, 13 University Park, Fredonia, N.Y. 14063

[21] Appl. No.: 676,965

[22] Filed: Apr. 13, 1976

Related U.S. Application Data

[63] Continuation-in-part of Ser. No. 518,547, Oct. 29, 1974, abandoned.

[51] Int. Cl.[2] ..... E02B 3/00

[52] U.S. Cl. ..... 61/1 R; 47/31

[58] Field of Search ..... 47/9, 31; 61/1 R, 2, 61/3, 7, 38

[56] References Cited

U.S. PATENT DOCUMENTS

| | | | |
|---|---|---|---|
| 1,382,069 | 6/1921 | Eckart | 47/9 |
| 3,151,463 | 10/1964 | Talbott | 61/1 R |
| 3,830,066 | 8/1974 | Larsen | 61/3 |
| 3,844,123 | 10/1974 | Larsen | 61/3 |

FOREIGN PATENT DOCUMENTS

| | | | |
|---|---|---|---|
| Ad. 55,819 | 9/1952 | France | 61/3 |
| 2,131,647 | 12/1971 | Germany | 61/7 |

*Primary Examiner*—Casmir A. Nunberg
*Assistant Examiner*—David H. Corbin
*Attorney, Agent, or Firm*—John J. Byrne; Edward E. Dyson

[57] ABSTRACT

A screen of foraminous material is laid directly on the surface of shallow water beds where weed growth is likely or is occurring. The screen is non-reactive to the surrounding water and creates a physical semi-barrier to rootlet and stem formation and to the transmission of light to the area therebetween to thereby retard germination and growth of weeds but not to stop growth entirely. The screen is formed with sufficient openings so that the normal movement of the surrounding water is not materially affected.

2 Claims, 3 Drawing Figures

FIG. 1
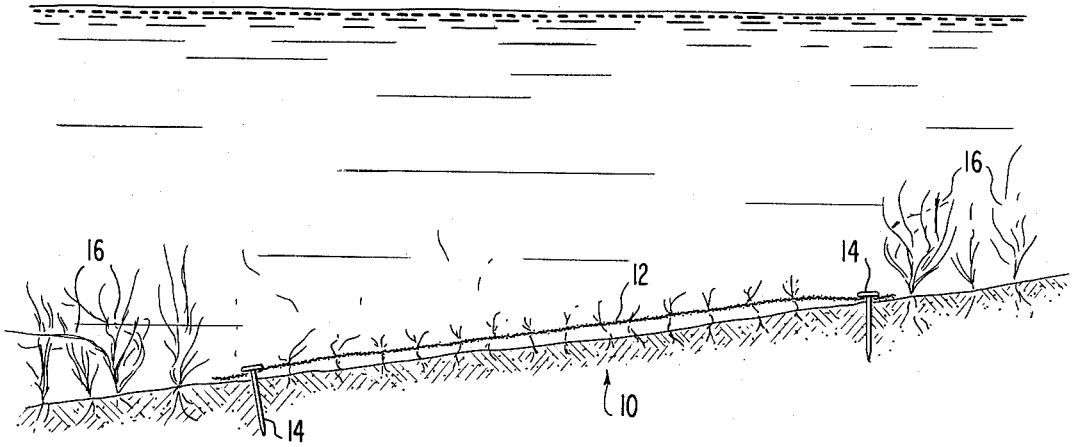
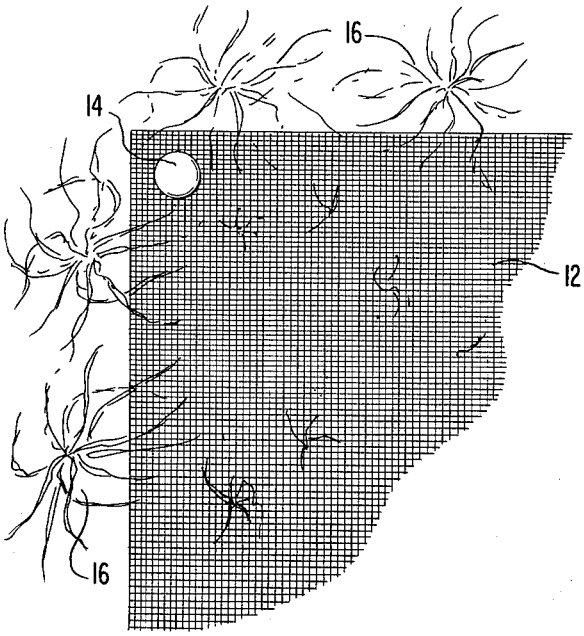
FIG. 2
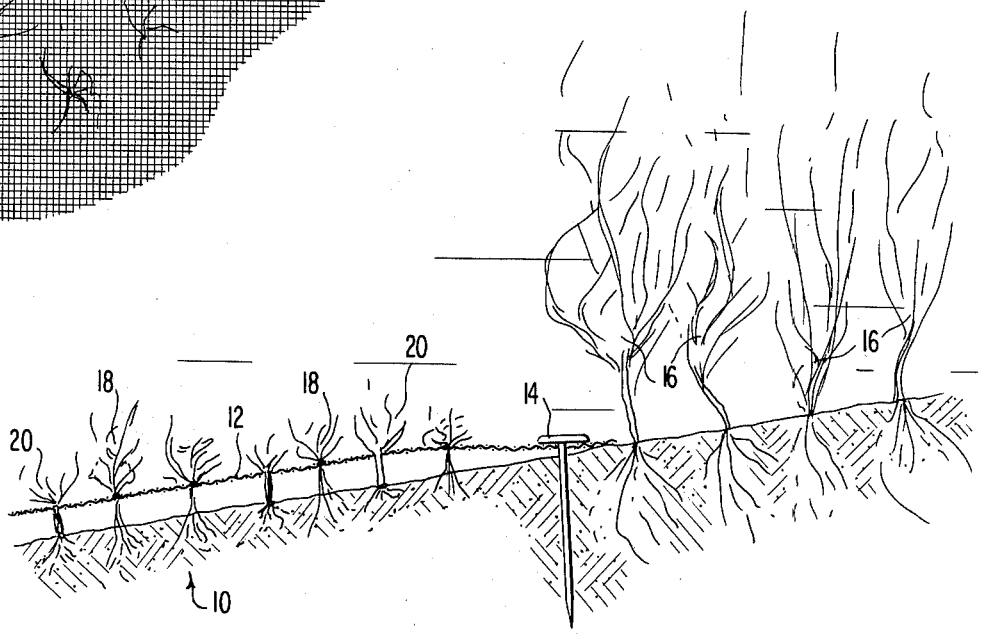
FIG. 3

BENTHIC SEMI-BARRIER TO CONTROL THE GROWTH OF WEEDS IN AQUATIC ENVIRONMENTS

This application is a continuation-in-part of my copending application Ser. No. 518,547, filed Oct. 29, 1974, now abandoned, entitled BENTHIC SEMI-BARRIER TO CONTROL THE GROWTH OF WEEDS IN AQUATIC ENVIRONMENTS.

Many bodies of water, especially warm, shallow lakes and reservoirs, most of which are important economically and aesthetically, are today beset with problems related both directly and indirectly to extensive and, at times, uncontrolled weed growth. Many of these bodies receive untreated or inadequately treated waste water. Further, many lakes and rivers receive additional nutrient and trace chemical contributions from agricultural and industrial sources. Taken together, these cultural environmental stresses have produced explosive biological growth, particularly in the summer, thus interfering with boating, fishing, swimming, water skiing, and the enjoyment of these aquatic resources.

Prior art management techniques attempting to control weed growth have included treatment of weed beds with chemicals (including arsenic compounds, sodium arsenite, and organic salts), harvesting of weeds with mechanical harvesting machines, and draw-downs of lakes when applicable. Chemical treatments have proven to be an unwise tradeoff of one problem for another, and, in some cases leading to long-term and persistent levels of unwanted chemicals or to undesirable changes in weed communities. Unanswered questions exist concerning overall impact of some chemicals upon the aquatic environment — especially the food chain. Weed harvesting, which is expensive in capital investment, operations, and equipment maintenance, must be repeated frequently and is not always effective. Draw-downs are impractical for most lakes and reservoirs and provide only short-term relief from weed growth.

A principal objective of this invention, therefore, is to provide an uncomplicated and inexpensive means for retarding and deterring weed growth in bodies of water so that they may be used for the aforementioned purposes.

Another important objective of this invention is to provide an inexpensive and efficient screen for limiting weed growth in specific selected areas without harmful effect on adjacent areas. For instance, although it may be desirable to discourage weed growth in one area, it may be desirable to encourage healthy weed growth in an adjacent area for the spawning, protection, and development of fish and fish food organisms.

Another important objective of this invention is to provide a means for controlling weed growth in selected areas which means are non-toxic to humans and fish and create no hazard to those installing or utilizing the invention.

A still further objective of this invention is to provide a weed-retarding screen that can be readily placed upon the bed of the area to be protected of a type which will produce no significant environmental stress to the lake except for the purposes for which it is intended. The screen of this invention provides only a semi-barrier and, therefore, will not prevent the exchange of water and dissolved materials with benthic organisms in the lake sediments. It is also an object of this invention to provide a screen which is removable at any time to thus allow the redevelopment of weed communities if and when desired.

Another important objective of this invention will be to provide a screen that is easily cleaned and is reusable from year to year as required.

Others have appreciated the advisability of controlling aquatic weed growth by developing a shield between the area to be protected and the sun's rays. For instance, in the Talbott U.S. Pat. No. 3,151,463, issued Oct. 6, 1964, there is shown a pneumatic pressure means for disturbing the bottom areas both to disturb weed seedlings to prevent germination and also to prevent germination by shading the sunlight via the dust shield created. This method is expensive, requires power to operate the pumping system, and can work only if loose sediment is present at the bottom area. In many aquatic environments, bottom sediment is not loose but is more like thick mud. The instant invention has as one of its principal objectives to eliminate such power requirements by providing a screen which is readily manufactured and is easily positioned upon water bed sediments of varying kinds.

The U.S. Pat. No. to Larson 3,830,066 discloses the placement of a flexible sheet in partially spaced relationship close to but above the sea bed. The purpose of the Larson sheet is to encourage the formation of sedimentary material therebeneath. Sediment, however, oftentimes contains those elements likely to spur weed growth. Of course, Larson is principally concerned with erosion. Where erosion is the problem, weed growth is seldom troublesome.

Another principal objective of this invention is to place a screen upon a water bed area wherein said screen has openings of a size to permit but limit weed stem and rootlet development.

These and other objects of the invention will become more apparent to those skilled in the art by reference to the following detailed description when viewed in light of the accompanying drawing wherein:

FIG. 1 is an elevation view of a portion of a water bed;

FIG. 2 is a plan view of a screen member; and

FIG. 3 is an enlarged cross-sectional view showing plant growth.

In accordance with the method of this invention, weed growth is retarded in the area 10 by placing a non-corrosive, foraminous screen 12 thereover. Fiberglass has been advantageously used for screens of this type. A mesh of 20 × 20 (400 apertures per sq. in.) has been used successfully. Of course, perforated screens could also work in place of a woven screen. The primary standard is that the material of the semi-barrier will not react with the water in which it is immersed and that it will have sufficient porosity not to appreciably hinder the movement of water and dissolved materials in the area between the water and the floor of the water body. Limited ingress and egress of water to and from the floor, the amount and depth of which is determined by the consistency of the soil, should be maintained for good ecological administration. It is best that the screen be non-metallic to eliminate the possible influence of trace metals although, in principle, any screen material could achieve the objectives stated herein.

The means of positioning and securing the screens in their proper location will depend on the bed conditions, the water turbulence and flow regularly encountered. In many instances where weeds are creating the aforementioned undesirable effect, the water is quite calm and the screen positioning is not a problem. The screen 12 can be secured directly on the bed by inserting stakes 14 in the floor bed.

In one experiment in the temperature zone, two fiberglass screens were placed at the bottom of a lake — Screen I approximately 250 feet from shore and Screen II near a docking area. Screen I, measuring 4 × 6', was placed directly upon an extensive, well developed weed bed at 6' depth consisting primarily of water milfoil (*Myriophyllum exalbescens*). Screen II, measuring 7 × 30', was positioned on a luxuriant weed community consisting principally of curly leaf pondweed (*Potomogeton crispus*) at 4' depth. The screens were each 400 mesh woven fiberglass. The screens were positioned in the lake and held there by 2 × 4 × 16 inch cinder blocks. In each test, the screens only partially covered the existing community of macrophytes.

A survey of the macrophyte community areas associated with Screens I and II was conducted approximately 1 year after installation. While healthy, abundant areas of water milfoil (M. *exalbescens*) and curly leaf pondweed (P. *crispus*) existed around the perimeter of both Screen I and Screen II, respectively, and while these macrophyte communities extended in all directions around both screens, little macrophyte growth was observed above or below the screens. The weed growth emergent through the screens consisted of dwarf plants with rootlet and/or stem development limited by screen aperture size. These dwarf plants averaged 4–5 inches in length while weeds surrounding the screens averaged 4–5 feet in length. Pre-existing weeds under the screens died off and decomposed within 2 weeks of screen placement. This combined effect of blocking light transmission and the stunting of either rootlet or stem growth obtains the objective of preserving ecological balance while converting an otherwise unusable body of water to recreational and other purposes.

In the enlarged view of FIG. 3 there is shown several plants. The large plants 16 represent unrestrained growth and the plants 18 and 20 represent stunted growths. The plant 18, for instance, represents a growth that may have started to germinate above the screen and its rootlet system finding its way into soil 10. Here the rootlet system is restricted and plant growth stunted. The numeral 20 represents a plant where the rootlet system started below the screen but since stem growth is restricted to the size of the apertures in the screen, plant growth is also retarded.

In a general manner, while there has been disclosed an effective and efficient embodiment of the invention, it should be well understood that the invention is not limited to such an embodiment, as there might be changes made in the arrangement, disposition, and form of the parts without departing from the principle of the present invention as comprehended within the scope of the accompanying claim.

I claim:

1. An ecologically harmless method of limiting weed growth in selected areas of the bottom of a body of water comprising the steps of:

placing a noncorrosive foraminous screen, having a plurality of generally uniform apertures, on an area to be treated upon existant plant life and in a co-planar relationship with the bottom of the body of water;

maintaining said noncorrosive foraminous screen in close proximity and co-planar relationship with the bottom of the body of water;

inhibiting plant growth in the area beneath said noncorrosive foraminous screen by, shielding said area from a substantial degree of the sun's rays with said noncorrosive foraminous screen; and limiting plant size in an area beneath and through said noncorrosive foraminous screen by, limiting the size of plant stems which extend through the foraminous screen to the size of the apertures in said noncorrosive foraminous screen.

2. An ecologically harmless method of limiting weed growth in selected areas of the bottom of a body of water as defined in claim 1 wherein:

said step of placing comprises placing a noncorrosive foraminous screen in position in close proximity with the bottom of the body of water wherein said foraminous screen has a porosity comprising approximately 400 apertures per square inch.

* * * * *